US007044144B2

(12) United States Patent
Hebert

(10) Patent No.: US 7,044,144 B2
(45) Date of Patent: May 16, 2006

(54) RELOCATABLE PRESSURE WASHER ADAPTER

(75) Inventor: Paul Hebert, Broussard, LA (US)

(73) Assignee: M-I L.L.C., Houston, TX (US)

( * ) Notice: Subject to any disclaimer, the term of this patent is extended or adjusted under 35 U.S.C. 154(b) by 264 days.

(21) Appl. No.: 10/444,149

(22) Filed: May 22, 2003

(65) Prior Publication Data

US 2005/0098196 A1 May 12, 2005

Related U.S. Application Data

(60) Provisional application No. 60/382,804, filed on May 23, 2002.

(51) Int. Cl.
*B08B 3/02* (2006.01)
*B08B 9/00* (2006.01)
*B05B 3/00* (2006.01)

(52) U.S. Cl. ..... 134/167 R; 134/177; 134/180; 239/227

(58) Field of Classification Search ..... 134/22, 134/18, 24, 167 R, 168 R, 169 R, 177, 180, 134/198; 239/227
See application file for complete search history.

(56) References Cited

U.S. PATENT DOCUMENTS 3,895,756 A 7/1975 Jaeger ..... 239/227
4,220,170 A 9/1980 Hebert et al. ..... 134/167 R
5,092,963 A * 3/1992 Barker et al. ..... 202/250
5,740,821 A 4/1998 Arnold ..... 134/113
5,776,257 A 7/1998 Arnold et al. ..... 134/11
6,192,905 B1 * 2/2001 Mincy et al. ..... 134/167 R
6,213,135 B1 * 4/2001 Moulder ..... 134/167 R

OTHER PUBLICATIONS

[online]. Retrieved from the Internet on May 7, 2002: <URL: http://www.petrosvs.co m/ma n-can.htm.

* cited by examiner

*Primary Examiner*—Joseph L. Perrin
(74) *Attorney, Agent, or Firm*—M-I L.L.C.

(57) ABSTRACT

Methods and apparatus for attaching a pressure washing device to a storage tank that allows adjustment of the location of the pressure washing device. One embodiment includes a mounting plate adapted to be connected to a tank opening, a second plate hingably attached to the mounting plate, and a pressure washer attachment plate hingably connected to the second plate. The hinged connections may be arranged such as to allow rotation about two axes that are substantially perpendicular to each other. Linear connection apparatus may also be provided to control the relative location between the plates. A roof mounted system includes a vertical extension arm that is suspended from a roof-mounted manway. The vertical extension arm supports a primary pivot point about which a first extension arm deploys. The first extension arm carries a telescoping extension arm that has a secondary pivot point about which pivots a wash head arm having a wash head mounted on the end.

7 Claims, 5 Drawing Sheets

RELOCATABLE PRESSURE WASHER ADAPTER

CROSS-REFERENCE TO RELATED APPLICATIONS

The present application claims priority to U.S. Provisional Application No. 60/382,804, filed May 23, 2002, titled "Relocatable Pressure Washer Adapter," and hereby incorporated herein by reference for all purposes.

STATEMENT REGARDING FEDERALLY SPONSORED RESEARCH OR DEVELOPMENT

Not applicable.

BACKGROUND OF THE INVENTION

The present invention relates generally to methods and apparatus for the cleaning deposits from the interior of storage tanks. More specifically, the present invention relates to methods and apparatus for attaching a pressure washing device to a storage tank that allows for adjustment of the location of the pressure washing device. More specifically, the preferred embodiments show a light-weight and easily relocatable device that can be transported to or permanently mounted on both stationary and transportable tanks to effect the jet washing of the tank.

In many industries, large storage tanks are commonly used for the storage of liquid products. The liquids stored in such tanks may contain materials that tend to deposit and build up on the interior of the tank. It is not uncommon to have several inches of material deposited before the tank is taken out of service for cleaning.

Storage tanks that are used for storing fluids used in the drilling of hydrocarbon wells are particularly susceptible to the build up of solids within the tanks. Drilling fluids are normally very dense fluids that have a high solids content. These solids will tend to settle out of the fluid and deposit within the storage tanks. This solid material can be very thick and difficult to remove from the tank.

In applications where the material in the tank is non-hazardous, the tank would normally be cleaned by personnel entering the tank through an access port, or manway, and manually cleaning the tank. These personnel may utilize suction hoses, hand-held pressure washers, shovels, and other tools, but the process has traditionally been a highly labor intensive endeavor.

One automated technique for cleaning storage tanks utilizes a programmable pressure washer that can be permanently mounted to the tank shell, or inserted through a permanently installed fitting. These systems usually include a rotating washer head that is provided with one or more nozzles that are moved automatically to make the wash head cover a specified area. These pressure washers are normally adapted to be installed in a fixed position relative to the tank with the wash head providing all the movement required.

In general, the tank geometry, including any internal obstructions, and the distribution of deposits make it difficult to match the washing pattern of a single washing head to a specific tank configuration because with the types of washing systems described above, usually some areas are more intensely washed than others. Further, so-called "shadowe" areas that are shielded from the direct impact of the jet by pipe, stanchions, baffles and the like, are not well cleaned. Therefore, many of the systems described above employ several washing heads simultaneously and may operate for extended periods of time, such that excess consumption of washing liquid may occur. This excess consumption of washing liquid represents a poor exploitation of time, an increased energy cost, possibly an undesired wear on the tank interior, and it involves an increased cost of purifying the waste liquid which is discharged in larger quantities than may be necessary. Further, in many cases, access is limited to a manway or other large openings in the tank, and nozzles positioned only at these locations cannot completely clean tanks with shadowed areas.

Thus, there remains a need in the art for methods and apparatus to improve the efficiency of tank washing systems. The embodiments of the present invention are directed to methods and apparatus for adjustably mounting a pressure washing system to any tank that needs to be cleaned, particularly those with internal shadowing elements. The embodiments include a system that can be permanently mounted or that is capable of being transported and put into place without the use of mechanical lifting equipment, thus overcoming the limitations of the prior art.

SUMMARY OF THE PREFERRED EMBODIMENTS

Provided herein are methods and apparatus for adjustably mounting a pressure washing system to a tank. The preferred embodiments of the present invention are characterized by an attachment mechanism that attaches to a manway on a tank and allows for the adjustable mounting of a pressure washing system.

One embodiment includes a mounting plate adapted to be connected to a tank opening and a pressure washer attachment plate hingably connected to the mounting plate and adapted to receive a pressure washing device. A linear connection apparatus may also be provided to control the relative location between the two plates. The linear connection apparatus may be manually adjusted or controlled by a hydraulic or pneumatic cylinder.

In another embodiment, the attachment mechanism includes a mounting plate adapted to be connected to a tank opening, a second plate hingably connected to the mounting plate, and a pressure washer attachment plate hingably connected to the second plate. The hinged connections may be arranged such as to allow rotation of the wash head about two axes that are substantially perpendicular to each other. Linear connection apparatus may also be provided to control the relative location between the plates. The linear connection apparatus may be manually adjusted or controlled by hydraulic or pneumatic cylinders.

In another embodiment, the attachment mechanism is suited for deploying a pressure washing device from the roof of a tank. The mechanism includes a vertical extension arm that is suspended from a roof-mounted manway. The vertical extension arm supports a primary pivot point about which a first extension arm deploys. A wash head is pivotally mounted to the end of the first extension arm. Alternatively, the wash head may be mounted to a telescoping extension arm that extends from the first extension arm. Pressurized wash fluid is supplied to the wash head through a hydraulic conduit, which may formed from the components of the system or alternatively by a separate conduit.

Thus, the present invention comprises a combination of features and advantages that enable it to substantially increase the efficiency of tank cleaning systems. These and various other characteristics and advantages of the present invention will be readily apparent to those skilled in the art upon reading the following detailed description of the preferred embodiments of the invention and by referring to the accompanying drawings.

BRIEF DESCRIPTION OF THE DRAWINGS

For a more detailed understanding of the preferred embodiments, reference is made to the accompanying Figures, wherein:

FIGS. 4*a*–4*d* are partial sectional views of a second embodiment of a pressure washing device attachment system.

DETAILED DESCRIPTION OF THE PREFERRED EMBODIMENTS

Figure 1B:
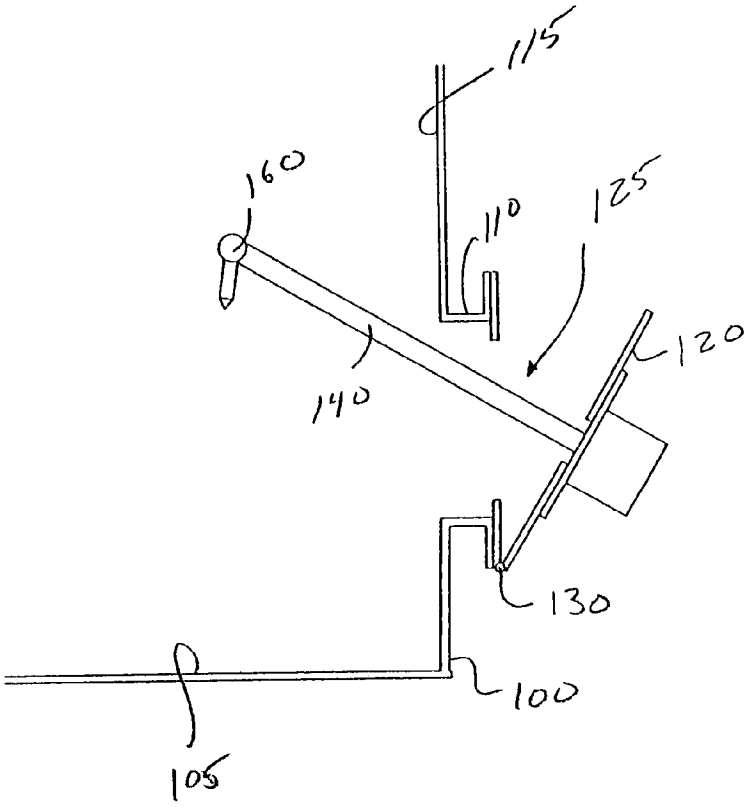
FIGS. 1*a* and 1*b* are partial sectional side views representing a pressure washing device disposed in a tank.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

The preferred embodiments of the present invention relate to methods and apparatus for adjustably attaching a pressure washing system to a storage tank. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

In particular, various embodiments of the present invention provide a number of different methods and apparatus for attaching a pressure washing system to a storage tank. Reference is made to attaching the pressure washer system to a manway of a storage tank, but the use of the concepts of the present invention is not limited to attachment to a manway and may be attached to any available access point. It is to be fully recognized that the different teachings of the embodiments discussed below may be employed separately or in any suitable combination to produce desired results.

In the discussion that follows the pressure washing device illustrated and discussed may be any available pressure washing system, such as those manufactured by Toftejorg, Inc. Such systems are well known in the art and may be characterized as having a wash head that is preprogrammed to spray pressurized wash fluid over a given area in a predetermined pattern. The wash head and its preprogrammed washing pattern are typically controlled by a control unit, located outside the tank. These systems may be self contained, powered only by the pressurized washing fluid, or may rely on other power, such as hydraulic, pneumatic, or electric, to control and move the wash head.

Figure 1A:
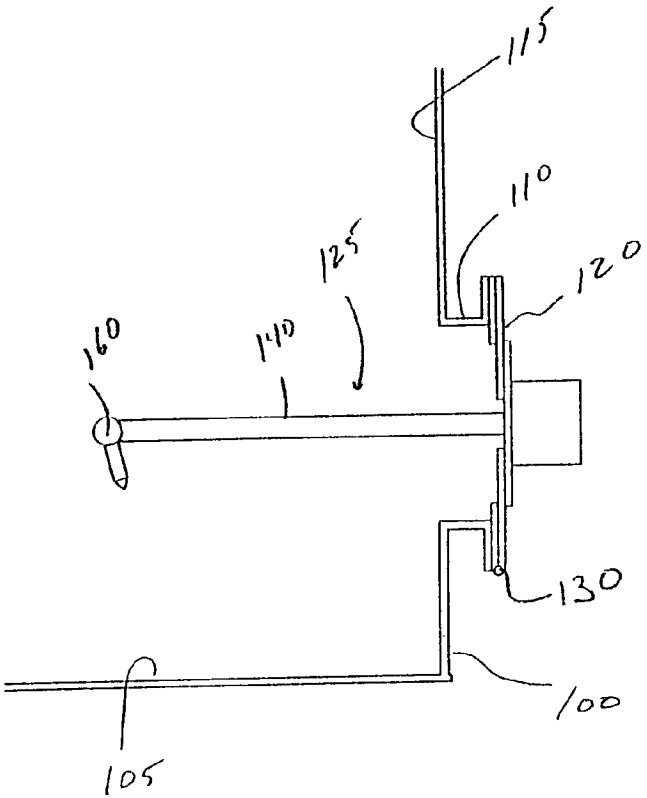

FIGS. 1*a* and 1*b* show a partial sectional, side-view of storage tank 100 having manway 110. Attached to manway 110 is a washing device 125 for removing deposits from the floor 105 and interior walls 115 of the tank. Washing device 125 includes wash head 160 that is located at the end of extension arm 140. Washing device 125 is removably affixed to attachment system 120 that allows rotation of device 125 about hinge 130. Hinge 130 is located on the lower edge of system 120 to allow for rotation of device 125 about a substantially horizontal axis. Although not shown in FIGS. 1*a* and 1*b*, attachment system 120 may include a adjustment mechanism to control the rotation of device 125 about hinge 130. This connection device may be a linear connection device as shown in, and discussed relative to, FIG. 3 or may be some other type of adjustment device.

In a first position, as shown in FIG. 1*a*, attachment system 120 maintains extension arm 140 in a substantially horizontal position. In a second position, as shown in FIG. 1*b*, attachment system 120 enables washing device 125 to be rotated about hinge 130 so that extension arm 140 is at an angle to the horizontal. In the second position, wash head 160 is farther away from tank bottom 105 allowing the head to cover a larger area. Although hinge 130 is shown on the lower edge of attachment system 120 is may also be on the upper edge to allow rotation of washing device 125 to place wash head 160 closer to the tank bottom 105 allowing the wash head to apply wash fluid in a concentrated area.

Figure 2B:
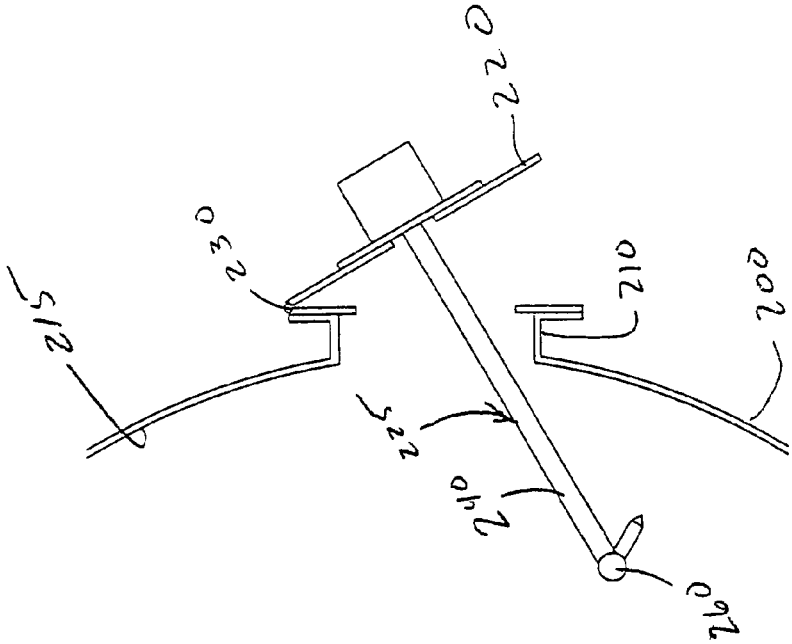
FIGS. 2*a* and 2*b* are partial sectional top views representing a pressure washing device disposed in a tank.
Figure 2A:
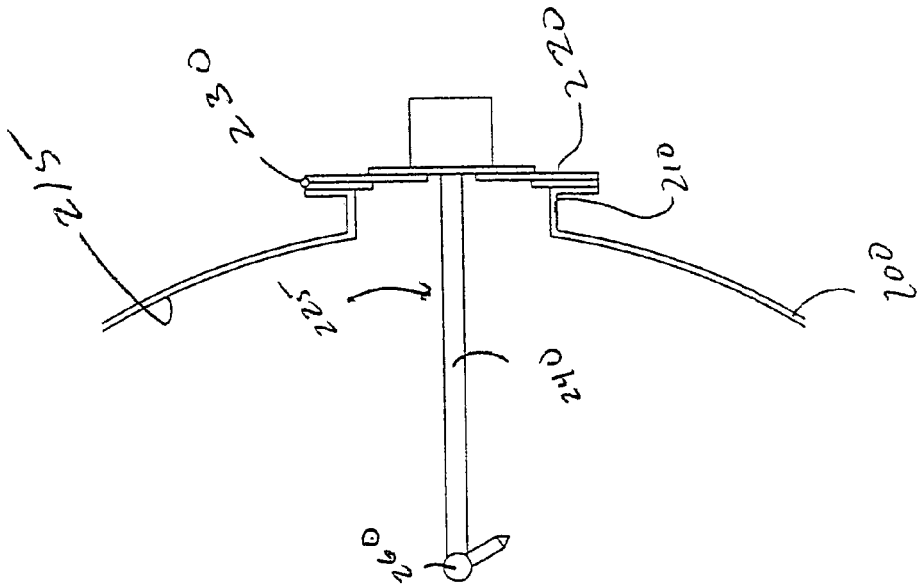

FIGS. 2*a* and 2*b* show a partial sectional, top-down view of storage tank 200 having a washing device 225 mounted to manway 210. Washing device 225 includes wash head 260 that is located at the end of extension arm 240 and controlled by a controller, which may be positioned at the other end of extension arm 240. Washing device 225 is removably affixed to attachment system 220 that allows rotation of device 225 about hinge 230. Hinge 230 is located on one side of system 220 to allow for rotation of device 225 about a substantially vertical axis. Although not shown in FIGS. 2*a* and 2*b*, attachment system 220 may include a connection device to control the rotation of device 225 about hinge 230. This connection device may be a linear locator as shown in, and discussed relative to, FIG. 3 or may be some other type of adjustment device.

In a first position, as shown in FIG. 2*a*, attachment system 220 maintains extension arm 240 in a position parallel with the central axis of manway 210. In a second position, as shown in FIG. 2*b*, attachment system 220 enables washing device 225 to be rotated about hinge 230 so that extension arm 240 is at an angle to the central axis of manway 210. In the second position, wash head 260 is closer to the tank wall 215 allowing a concentrated application of washing fluid by the wash head. Hinge 230 may alternatively be located on the opposite edge of attachment system 220 allowing rotation of washing device 225 in the opposite direction.

Figure 3:
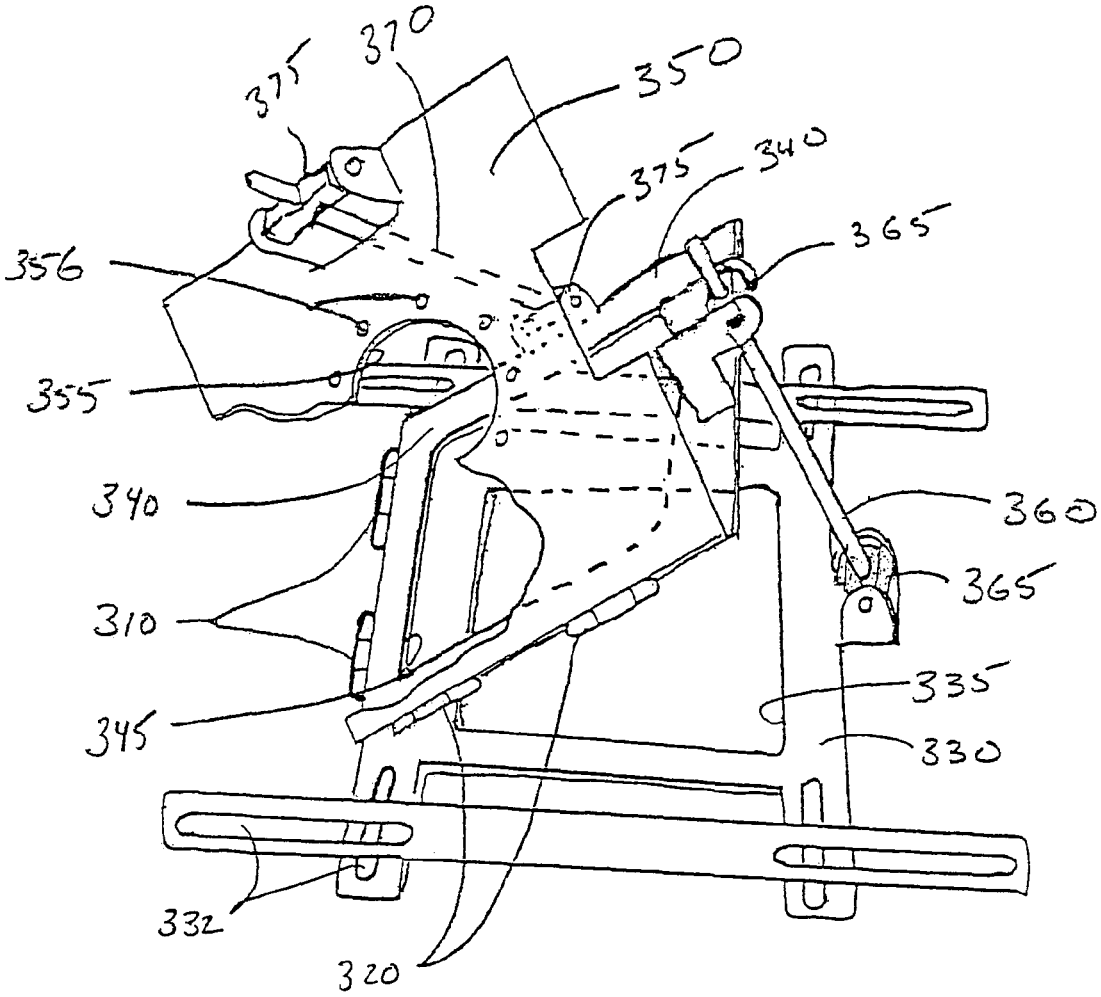
FIG. 3 is a perspective view of one embodiment of a pressure washing device attachment system.

FIG. 3 shows an alternative embodiment of an attachment system 300 that includes two sets of hinges 310, 320 that allow for movement of a washing device (not shown) about two substantially perpendicular axes. System 300 includes a manway mounting plate 330, adapted to be connected to a tank wall and hingably attached to a second plate 340 that is hingably attached to a washing device attachment plate 350. The orientation of attachment plate 350 relative to second plate 340 is controlled by linear locator 370, while the relative orientation of second plate 340 to mounting plate 330 is controlled by linear locator 360. Plates 330, 340, and 350 are preferably constructed from steel plate or some other lightweight material that provides desirable strength characteristics but is compact and light enough to be easily portable.

Manway mounting plate 330 includes access hole 335 and a connection point 365 that connects linear locator 360 to the plate. Mounting plate 330 also may include slots 332 that allow the plate to be attached to a range of manway sizes by bolting directly to the manway bolt pattern. Hinges 320 are also attached between mounting plate 330 and second plate 340. Access hole 335 provides clearance for the pressure washing device (not shown) to pass through mounting plate 330.

Second plate 340 includes access hole 345 and connection points 365 and 375 that connect linear locators 360 and 370 to the plate. Second plate 340 also includes hinges 310 that attach to plate 350 and hinges 320 that attach to plate 330. Access hole 345 provides clearance for the pressure washing device (not shown) to pass through second plate 340.

Attachment plate 350 includes access hole 355 and a means for attachment 356, which may be a bolt pattern, for attaching a washing device (not shown). Hinges 310 attach plate 350 to plate 340 and the relative position between the two plates is controlled by linear locator 370.

Linear locators 360 and 370 may be threaded rods that interface with threaded connection points 365 and 375 that are pivotally mounted to plates 330, 340, and 350. Locators 360 and 370 may be designed so that once adjusted to a desired location, the locators are retained in position without intervention from the operator. Locators 360 and 370 alternatively may be hydraulic or pneumatic cylinders that are pivotally attached to plates 330, 340, and 350 and are actuated by a hydraulic or pneumatic power source.

Pressure washing device attachment system 300 may be used by attaching manway mounting plate 330 to a manway, or other access port, on a tank. System 300 is preferably attached using releasable connection members, such as bolts, connected to a bolt pattern on the manway. A pressure washing device is then attached to attachment means 356 so that the extension arm of the device extends through access holes 355, 345, and 335 into the interior of the tank. Washing device may alternatively be connected to attachment system 300 prior to system 300 being attached to the tank. Once system 300 is secured to the tank, linear locators 360, 370 can then be adjusted to place the wash head into the desired position for cleaning. The pressure washing device can then be activated and allowed to clean the tank without intervention from the operator.

FIGS. 4*a*–4*d* depict an alternative pressure washing device attachment system 420 for use in deploying a pressure washing device through a manway 410 in the roof of a tank 400. This embodiment is especially suited for washing the upper regions of the tank and in particular those regions that may have shadowed areas created by structural supports. Attachment system 420 includes a vertical extension arm 440, a primary pivot point 450, a first extension arm 460, a telescoping extension arm 470, a secondary pivot point 480, a wash head arm 490, and wash head 500. Wash head 500 may be a programmable wash head, as described above, or a cleaning tool that provides 360° of coverage without a preprogrammed pattern. Pressurized wash fluid is supplied to wash head 500 through a hydraulic conduit, which may formed from the components of system 420. System 420 is preferably constructed from lightweight tubular members, such as aluminum pipe or tube.

Figure 4A:
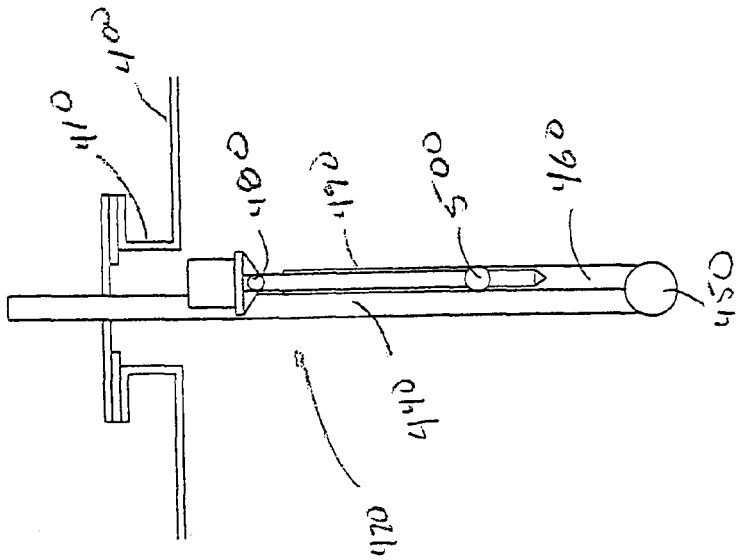
Figure 4B:
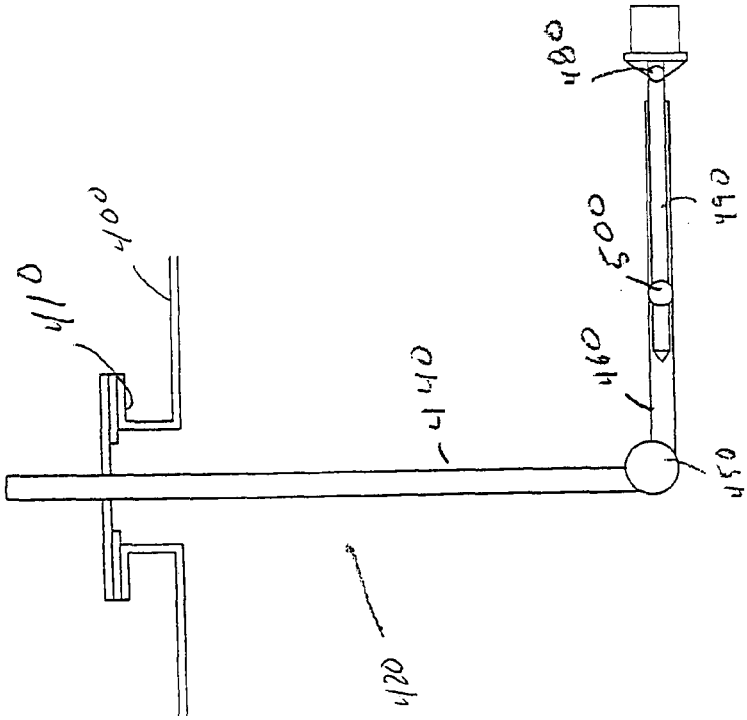
Figure 4B:
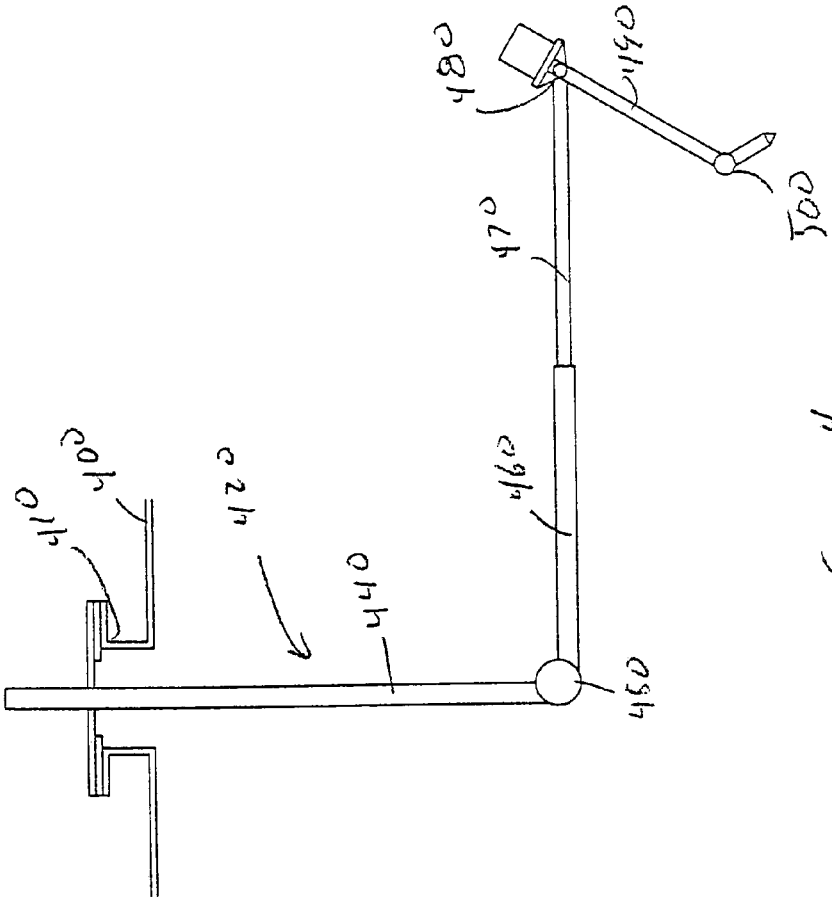
Figure 4B:
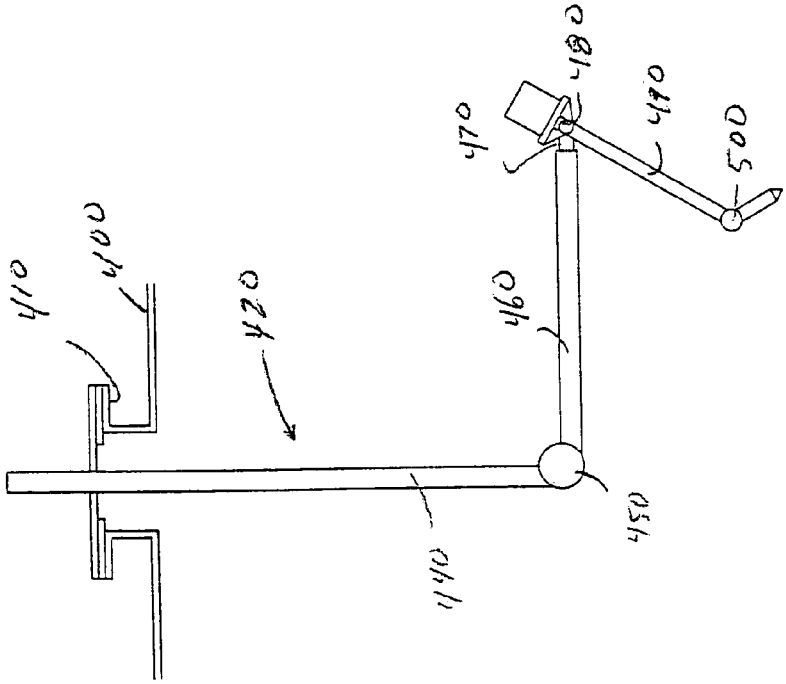

FIG. 4*a* depicts system 420 in a collapsed position so as to enable easy travel through manway 410. System 420 may be attached to manway 410 by a stationary support, a hinged support, such as that described above, or a rotating support. Once inside the tank, first extension arm 460 is pivoted about primary pivot point 450 to its desired deployment position, as shown in FIG. 4*b*. This position may be any angle relative to vertical extension arm 440. The pivoting and the deployment angle of arm 460 may be controlled by cables and pulleys operated from outside the tank or by a hydraulic control mechanism.

Once the first extension arm 460 is in the desired position, telescoping extension arm 470 can be extended from its stored position inside of arm 460 to an extended position, as shown in FIG. 4*c*. This deployment may be controlled by a gear or chain drive operated from the surface or by a hydraulic control mechanism. Once arm 470 has been deployed, wash head arm 490 can be rotated about secondary pivot point 480 to position wash head 500 in the desired location for washing. Secondary pivot point 480, coupled with the range of motion of wash head 500, provide full coverage in any direction from wash head 500. The rotation of wash head arm 490 may be manually or hydraulically controlled from outside the tank.

Alternatively, wash head arm 490 can be rotated about secondary pivot point 480 to position wash head 500 in the desired location for washing without extending arm 470, as shown in FIG. 4*d*. Likewise, any subset and combination of components from system 420 may be used during any deployment of the system to position wash head 500 in the desired location. System 420 may be removed from the tank by reversing the deployment process.

Thus, the above described embodiments provide a pressure washing device attachment system that is lightweight and easy to install. The preferred system can be transported and installed into a tank by a single operator. The preferred system also needs no external power source to locate the wash head in a desired area and only requires a source of pressurized fluid supplied to the pressure washing device. The preferred system also provides for adjusting the location of the wash head in at least two directions without detaching from the manway. Furthermore, the preferred system can enable the entire area that is desired to be cleaned to be effectively and efficiently cleaned.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A system for cleaning an enclosed space comprising:

a mounting plate connected to a wall around an opening into the enclosed space;

an attachment plate hingably connected to said mounting plate;

a washing device attached to said attachment plate and extending into the enclosed space; and a linear locator extending between an unhinged side of the mounting plate and an unhinged side of the attachment plate, wherein said linear locator controls the position of said unhinged side of said attachment plate relative to said unhinged side of said mounting plate, thereby controlling the position of the washing device in the enclosed space.

2. The system of claim 1 wherein said linear locator is manually controlled.

3. The system of claim 1 wherein said linear locator is controlled by a hydraulic or pneumatic cylinder.

4. The system of claim 1 wherein said washing device is adjustably positioned such that shadowed areas within the enclosed space are reached by cleaning fluid dispersed from the washing device.

5. The system of claim 1 wherein the system is transportable between two openings by a single person.

6. The system of claim 1 wherein said washing device comprises:

a wash head operable to disperse washing fluid onto a cleaning area;

an extension arm having a first end at which said wash head is attached; and a controller attached to a second end of said extension arm; and wherein the controller is operable to supply washing fluid and control signals to said wash head.

7. The system of claim 6 wherein said washing device is mounted such that said controller is outside the cleaning area and said wash head is inside the cleaning area.

* * * * *